US005400913A

United States Patent [19]

Kelly

[11] Patent Number: 5,400,913

[45] Date of Patent: Mar. 28, 1995

[54] TAMPER-INDICATING CLOSURE

[75] Inventor: Ronald L. Kelly, Chester, Va.

[73] Assignee: Crown Cork & Seal Company, Philadelphia, Pa.

[21] Appl. No.: 995,765

[22] Filed: Dec. 23, 1992

[51] Int. Cl.[6] ..... B65D 41/34

[52] U.S. Cl. ..... 215/252

[58] Field of Search ..... 215/252, 258

[56] References Cited

U.S. PATENT DOCUMENTS

| | | | |
|---|---|---|---|
| 3,673,761 | 7/1972 | Leitz | 53/42 |
| 4,470,513 | 9/1984 | Ostrowsky | 215/252 |
| 4,511,053 | 4/1985 | Brandes et al. | 215/252 |
| 4,657,153 | 4/1987 | Hayes | 215/252 |
| 4,694,969 | 9/1987 | Granat | 215/252 |
| 4,771,904 | 9/1988 | Perne et al. | 215/252 |
| 4,801,031 | 1/1989 | Barriac | 215/252 |
| 4,895,265 | 1/1990 | Luch et al. | 215/31 |
| 5,058,755 | 10/1991 | Hayes | 215/252 |
| 5,090,788 | 2/1992 | Ingram et al. | 215/252 |

FOREIGN PATENT DOCUMENTS 1482603 1/1969 Germany .

*Primary Examiner*—Allan N. Shoap
*Assistant Examiner*—Vanessa Caretto
*Attorney, Agent, or Firm*—Woodcock Washburn Kurtz Mackiewicz & Norris

[57] ABSTRACT

A tamper-indicating closure serves as a closure for a container (2) which, at its container neck (3), possesses at least one locking surface (5) with which the retaining elements (6) of the tamper indicating band (7) are able to engage. The tamper-indicating band (7) possesses an upper portion (10) which extends downwards from the cap skirt (12) and which is connected with this by a frangible line (11). A plurality of retaining elements (6) are provided on the upper portion (10) of the tamper-indicating band (7). The retaining elements (6) are in each case connected with the adjacent retaining element by a flexible web (13). Each of the retaining elements (6) possesses at least one wedge shape (8) on its surface oriented towards the container neck (3).

13 Claims, 4 Drawing Sheets

TAMPER-INDICATING CLOSURE

BACKGROUND OF THE INVENTION

The invention relates to improvements in tamper-indicating closures as well as an integrally molded blank for the manufacture of a tamper-indicating closure.

Tamper-indicating closures for various types of containers are widely and numerously known and in use. These types of closure are mainly employed in the beverage and food industry for the most varied of uses. In order to hinder manipulation of such containers, mainly bottles, the closures are provided with a tamper-indicating band which is brought into engagement with a locking surface on the container neck. A protruding bead, one or more ribs, a groove or another shape for an undercutting on the container neck mostly serve as the locking surface.

One difficulty with the use of known closures is mainly that the tamper-indicating band on the one hand should slip over the container neck and locking surface easily and without damage to the frangible web or bridges connecting the band to the closure. In addition the tamper-indicating band must be elastic, in order to avoid too great a resistance when closing the bottle and, with that, damage to the frangible line.

On the other hand, the tamper-indicating band should be formed to be as stiff and resistant as possible, in order to reliably maintain engagement with the locking surface when opening the tamper-indicating closure, so that the tamper-indicating band will tear along the frangible line and thus display the initial opening.

These types of closures can be manufactured in one piece, together with the tamper-indicating band, by means of plastic injection molding. However, subsequent application of a weakened line to the closure blanks, between the closure cap and the tamper-indicating band, is also known. These types of devices and methods are known from U.S. Pat. No. 3,673,761 (Light/CibaGelgy), DE-OS-14 82 603 (Telllac/ALCA SA) or U.S. Pat. No. 4,895,265 (Luc et al./The West Co.).

However, tamper-indicating closures made of metal are also known on which a tamper-indicating band is subsequently affixed. The tamper-indicating element is, with that, normally annular in shape with a holding portion, with which it can be brought into interlocking connection with the closure cap. The holder portion-and with that the closure cap-is connected with the tamper-indicating band by means of connecting bridges or webs.

Other methods of manufacture of such tamper-indicating closures, such as compression molding, co-injection molding and similar, are also known.

A tamper-indicating band is known from U.S. Pat. No. 4,801,031 with which an inwardly folded tamper-indicating band possesses pleats in its end area, said pleats being directed inwards. On the one hand, this type of tamper-indicating band can be too stiff in its upper edge area, because the tamper-indicating band exists with its full material thickness between the individual fold-type protrusions. On the other hand, there is the risk that, during opening of the closure and thus with a vertical pressure being exerted onto the folds, the lower area of the tamper-indicating band will elastically yield and as a result the folds can slip over the retaining surface without tearing of the frangible line.

A closure is known from U.S. Pat. No. 4,470,513 (Ostrowsky/Ethyl Molded Products), the tamper-indicating band of which possesses a plurality of retaining elements which are provided with wedge shaped protrusions. It is apparent that such a closure can be further improved with reference to the stretching ability of the tamper-indicating band during initial placement and with reference to its engagement properties with the retaining surface.

SUMMARY OF THE INVENTION

The invention serves the purpose of improving tamper-indicating closures, in particular the various types of tamper-indicating closures as previously described, in such a way that the tamper-indicating band on the one hand will slip over a container neck during closure easily and without excessive loading of the frangible line, and on the other hand will achieve firm engagement, as secure against tampering as possible, with the locking surface. Economic manufacture shall at the same time remain assured.

The invention makes use of a combination of a plurality of known and also new features in order to achieve the set goal. It is based on individual retaining elements arranged at a distance from one another, since these will on the one hand put up less resistance when placing the closure on a container, and on the other hand adapt better to the neck of the container, thus offering greater security. The connection of the retaining elements by means of flexible webs ensures high elasticity of the arrangement during placement on a container neck. At the same time, by the connection of the individual retaining elements it is also ensured that there will be cohesion between the individual elements so that greater security during opening of the tamper-indicating closure will occur. Each individual retaining element locks itself on the one hand against the locking surface and is, on the other hand, supported by adjacent retaining elements.

Since each of the retaining elements possesses a wedge shape which in principle extends its whole length, the retaining elements are exceptionally resistant to bending under pressure loading. This has the effect that if, during opening of the container, the retaining element is pressed against the locking surface it is reliably ensured that the retaining elements will not simply bend or yield in another way to the pressure loading. Rather, they are, on the basis of the wedge shape, resistant to bending so that the force exerted onto them from the locking surface of the container will be guided in a longitudinal direction immediately into the upper portion of the tamper-indicating band, which transfers the force as a tensile load onto the frangible line and, with that, reliably initiates tearing of the frangible line. The wedge shape can, with that, be so formed that each wedge tapers away downwards toward the lower edge of the tamper-indicating band. It is, however, also possible to permit the wedge shape to run up to the lower edge, if a particularly stable version is desired.

Through raising of the stability as a result of the selected wedge shape, the wall of each retaining element can be of a thinner design, through which greater flexibility will be achieved.

If the back side of the retaining element is shaped to be flat, and merely the surface oriented toward the container neck possesses a wedge shape, very high stiffness of the retaining element can be achieved. If, on the other hand, the front side and the back side of the retaining element are formed as a wedge, in cross section an approximately V-shaped retaining element will ensue which can elastically yield during placement on a container neck. This is desirable mainly with container necks of small diameter, particularly in the case of beverage bottles.

The wedge shape can, depending on the type of use, possess a shape which runs into a tip or a rounded form. The shape which runs into a tip will guarantee particulary good hooking of the retaining elements behind the locking surface. With a rounded form, a wider contact surface will result which, for example, can be advantageous in the case of beverage bottles with beads as a locking surface.

Each individual wedge shape can also possess more than one wedge shape on its surface with advantage. Each of these wedge shapes leads to stiffening in the longitudinal direction.

In so far as particular demands are placed on the expansion of the tamper-indicating band during placement on a container neck, it can be useful if the retaining element is provided with an elastic web at the vertex of the wedge.

Additional tamper-indicating security can be achieved if the web between the retaining elements in each case is formed to be thin in such a way that it serves as a frangible line in order to display manipulations.

The tamper-indicating closure according to the invention can be manufactured in a particularly simple way if the tamper-indicating band, comprising the upper portion and the adjacent retaining elements, is manufactured as a cylindrical continuation of the cap skirt and if, subsequently, the retaining elements are bent back inwards and upwards in the direction of the cap base. The backwards bending is here facilitated if each retaining element is connected with the cap skirt by means of a hinge element. The hinge element can take the form of a thinning of the material.

The elastic expansion of the retaining elements can be further improved if the hinge element possesses a connecting portion which is connected with the lower edge of the upper tamper-indicating band portion and whose wall thickness is thinner than the wall thickness of the upper portion and which runs with a radially inwardly and downwardly directed angle. Since the retaining elements are essentially longer than the connecting portion, these take effect with a relatively long lever arm on the connecting portion and cause pivoting and deflection of the retaining elements during initial placement, even with relatively slight pressing forces.

It is of particular advantage if the angle of the connecting portion in relation to the longitudinal axis of the closure cap amounts, at the same time, to approximately between 30 degrees and 60 degrees, with advantage approximately 45 degrees. Additional elasticity can be at the same time achieved if the lower edge of the upper tamper-indicating band portion possesses an indentation and if the connecting portion is arranged on the side of the indentation lying radially inside.

A stiffening of the individual retaining elements against one another can be additionally achieved if the hinge element is provided collectively for a plurality of retaining elements and if the individual retaining elements are connected with the hinge element. This stabilising effect can be still further increased if the hinge element possesses and annular bead directed approximately radially inwards.

DETAILED DESCRIPTION OF THE PREFERRED EMBODIMENTS

Figure 1:
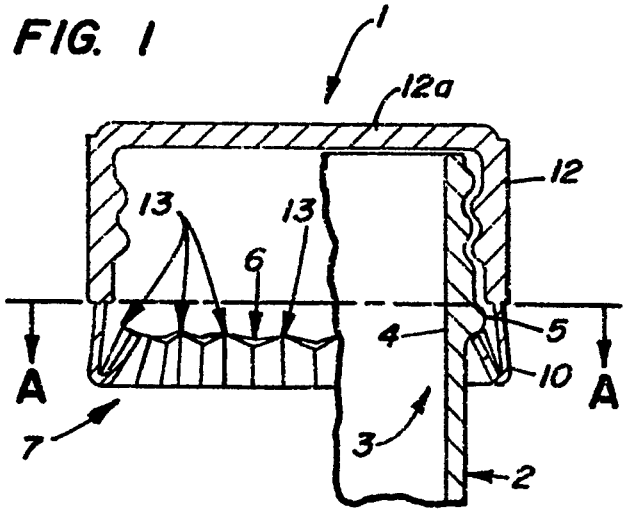
FIG. 1 is a [Schematic] cross-sectional fragmentary representation of a tamper-indicating closure according to a preferred embodiment of the invention.
Figure 4:
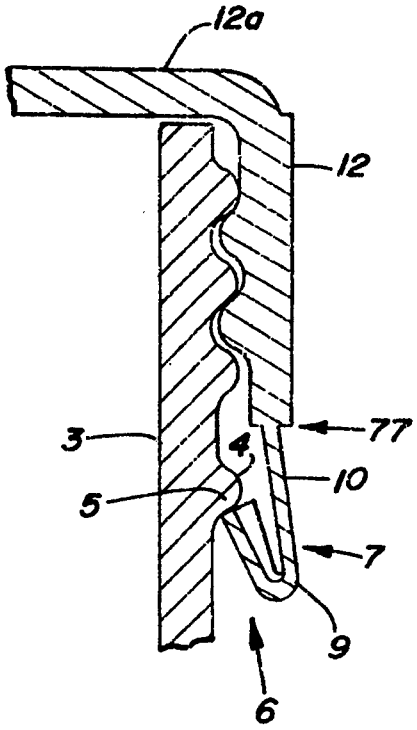
FIG. 4 is an enlarged representation of a partial section taken along the line B—B in FIG. 2.
Figure 2:
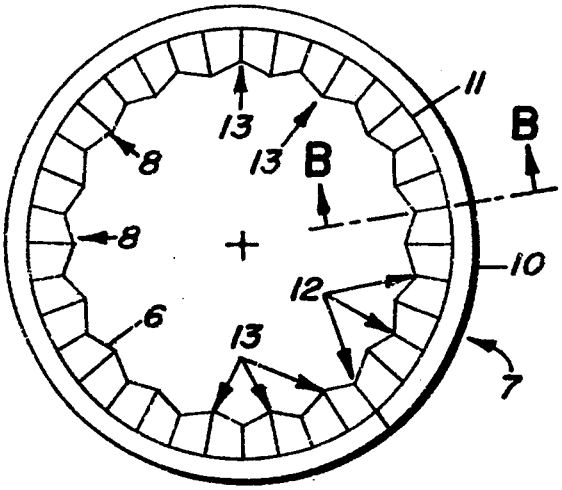
FIG. 2 depicts the tamper-indicating closure according to FIG. 1 viewed from below.

According to FIG. 1, a tamper-indicating closure 1 for closure of a container 2 is anticipated, a beverage bottle with a container neck 3 being represented as a container. An annular circumferential bead 4 is provided on the container neck 3, the lower edge of which forms a locking surface 5 with which retaining elements 6 of the tamper-indicating band 7 can engage. As can be seen in FIGS. 1 to 5, each of the retaining elements 6 is, through a section running parallel to the cap base 12*a*, formed to be V-shaped. The surface oriented towards the container neck 3 of each retaining element 6 consequently possesses a wedge shape 8. Apart from that, each retaining element is, on its underside, connected by a hinge element 9 with the upper portion 10 of the tamper-indicating band, said tamper-indicating band being likewise connected along a frangible line 11 with the cylindrical cap skirt 12. The frangible line 11 is formed as a material weakness of the upper portion 10 of the tamper-indicating band 7. As can be mainly seen in FIG. 4, the wedge shape 8 of the tamper-indicating band 7 tapers away downwards towards the hinge element 9.

The individual retaining elements 6 are connected flexibly with each other by means of webs 13. During initial screwing on of the tamper-indicating closure 1 onto the container neck 3, the retaining elements 6 can slide elastically over the bead 4 without at the same time the frangible line 11 being destroyed. On the one hand, the elasticity of the tamper-indicating band 7 is assisted by the webs 13. On the other hand, the retaining elements 6 can, because of their wedge shape, be pressed outwards, the wedge shape becoming flattened and through that the inside diameter becoming enlarged, in order to permit passing over the bead 4.

After closure of the container 2, the retaining elements 6, because of the elasticity of their material, will press inwards once again and achieve engagement with the locking surface 5 of the bead 4. Because of the wedge shape, the retaining elements 6 are longitudinally exceptionally stiff, so that, during opening of the container, deformation of the retaining elements 6, or slipping past the bead 4 in another way, is prevented. Apart from that, the webs 13 ensure good cohesion of the entire arrangement of all retaining elements 6. As is evident from FIG. 3, the tamper-indicating band 7 is connected firmly with the cap skirt 12 by means of a strengthened bridge 14. When opening the tamper-indicating closure the frangible line 11, formed as a thin web, will thus tear and in addition the vertical frangible line 15 will tear, so that the tamper-indicating band 7 will be separated from the cap skirt 12 along the frangible line 11 and will remain connected with the cap skirt solely at the bridge 14.

Figure 6:
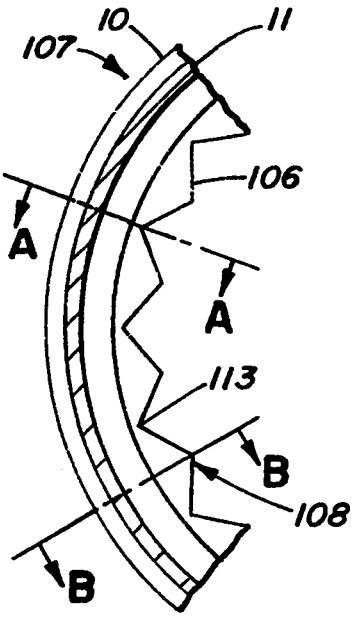
FIG. 6 is a partial section, similar to FIG. 5, showing a modified embodiment of the invention.

FIG. 6 shows a modified embodiment of a tamper-indicating band 107 with retaining elements 106 which are, as a body, in cross section formed as a wedge shape. This cross sectional shape ensures particularly good stiffness of the retaining elements longitudinally.

Figure 7:
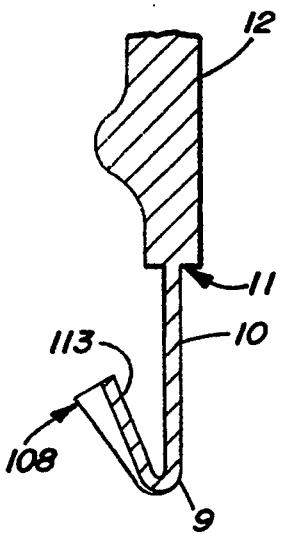
FIG. 7 is a partial section taken along the line A—A in FIG. 6.

FIG. 7 shows a section along the line A—A in FIG. 6, which runs through the web 113 between two retaining elements 106.

Figure 8:
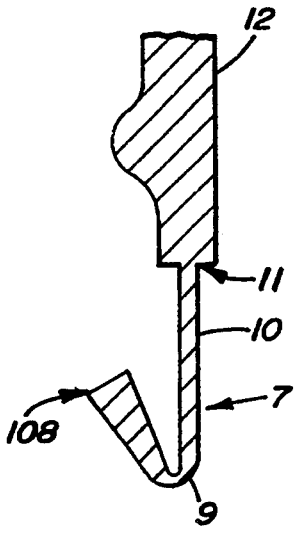
FIG. 8 is a partial section taken along the line B—B in FIG. 6.

FIG. 8 shows a section along the line B—B in FIG. 6, which runs through the thickest point of the wedge shape 108.

Figure 9:
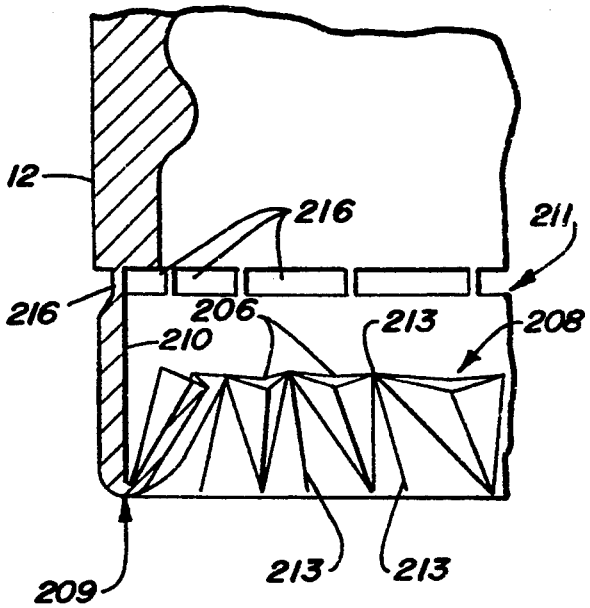
FIG. 9 is an embodiment of a tamper-indicating closure with a modified frangible line.

FIG. 9 shows a modified embodiment according to FIG. 1, with which the frangible line 211 comprises a plurality of bridges 216 which are able to tear away. Apart from that, the hinge element 209, for connection of the upper portion 210 of the tamper-indicating band 207 with the individual retaining elements 206, is formed as a reduction in the material. Through that, the retaining elements 206, after manufacture of the integrally molded blank, can be bent inwards particularly well.

Figure 10:
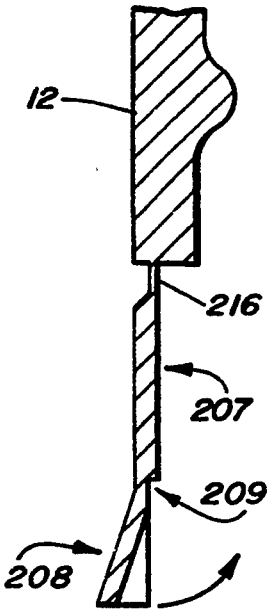
FIG. 10 is a partial section through the tamper-indicating band of the closure according to FIG. 9 in the area of the wedge tip and prior to bending back of the retaining element.
Figure 11:
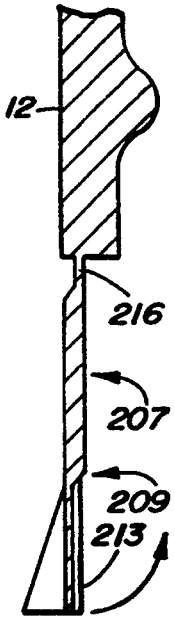
FIG. 11 is a partial section through the web in accordance with FIG. 10.

FIGS. 10 and 11 show, with that, partial sections in accordance with FIGS. 7 and 8, one through the tip of the wedge shape 208 and one through the web 213.

Figure 12:
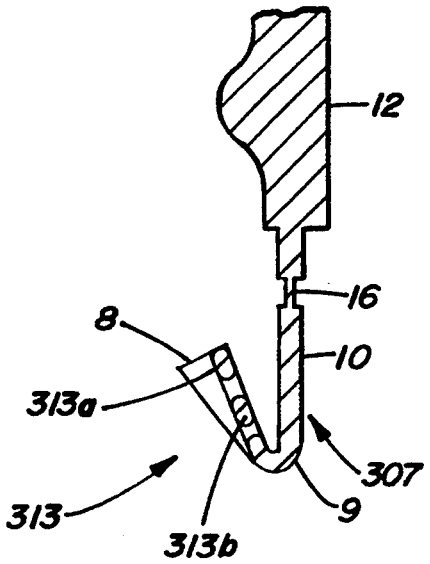
FIG. 12 is a partial section representing a web with interruptions.

FIG. 12 shows the embodiment of a tamper-indicating band 307 with which the web 13 comprises individual bridges **313*a* and 313*b*. The bridges 313*a* and 313*b*** relatively easily damaged so that they can be destroyed during manipulation.

Figure 13:
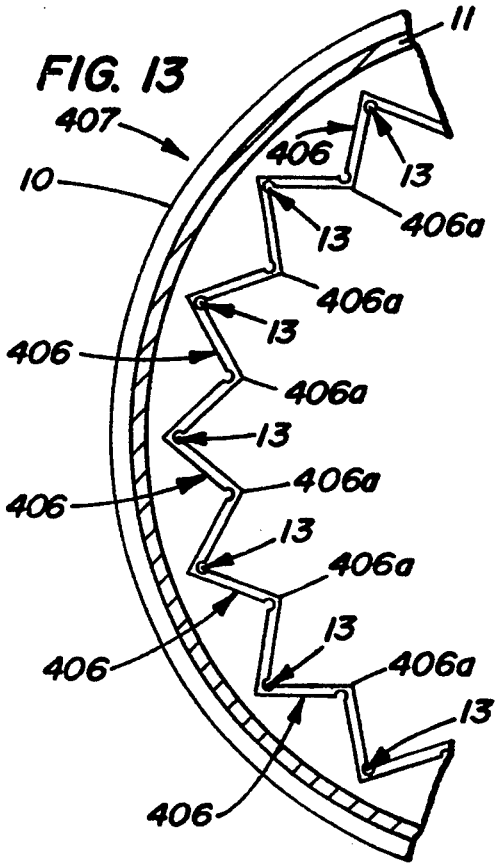
FIG. 13 is an alternative embodiment of the invention with two part retaining elements.

FIG. 13 shows a partial section through an embodiment of a tamper-indicator band 407 with which each retaining element 406 is subdivided by a web **406*a*. The web 406*a*** ensures high elasticity of the tamper-indicating band during closure.

Figure 14:
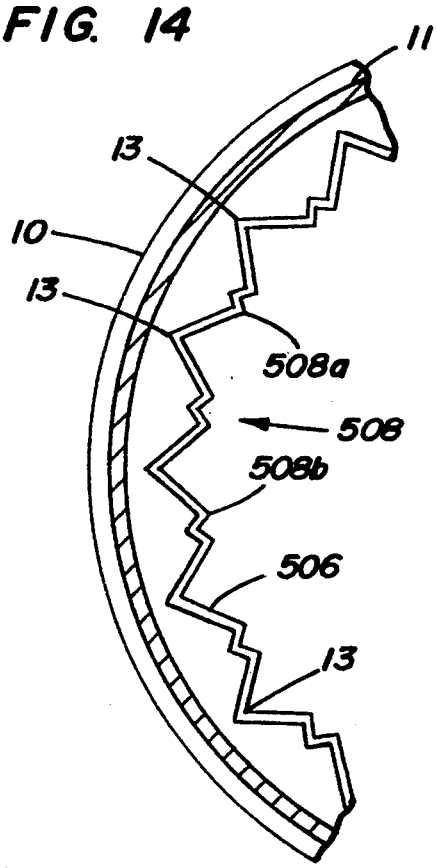
FIG. 14 is an embodiment with a double wedge shape for each retaining element.

FIG. 14 shows an embodiment with which each retaining element 506 is provided with two wedge tips **508*a*, 508*b*, which are directed inwards. By means of this shape, the number of wedge shapes 508 making contact with a locking surface 5 (FIGS. 1 and 4) is doubled, without the elastic deformability of the retaining elements 506 being reduced when compared with the embodiments according to the FIGS. 1 to 13. Evidentially, according to the configuration of the container 2 to be closed and the locking surface 5, the individual retaining elements 506 can also be provided with more than just two wedge shapes 508*a* and 508*b***, without departing from the framework of the invention.

Figure 5:
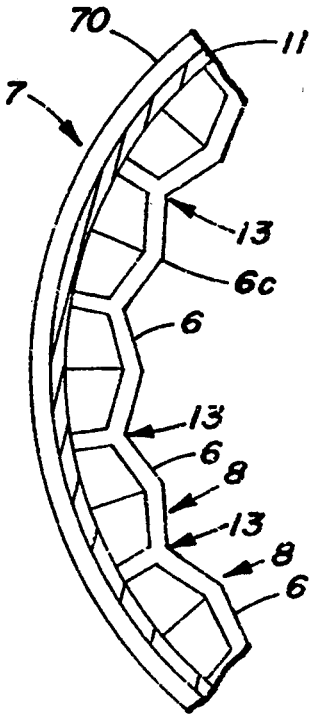
FIG. 5 is an enlarged detail from the sectional representation shown in FIG. 3.
Figure 3:
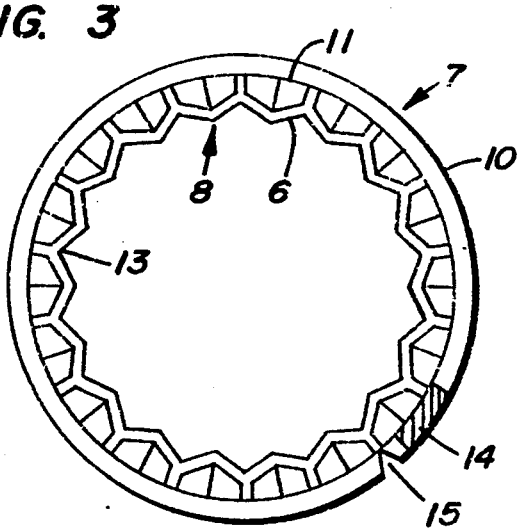
FIG. 3 is a section along the line A—A in FIG. 1.
Figure 15:
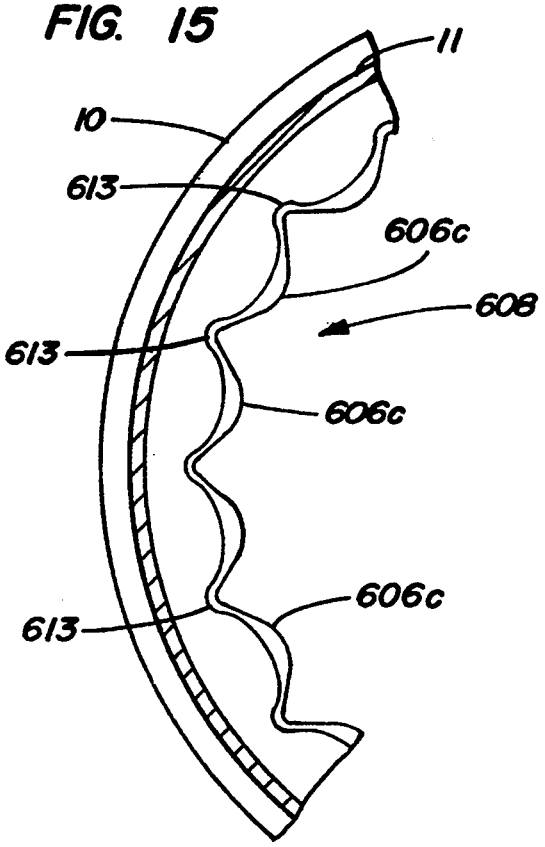
FIG. 15 is an embodiment with rounded wedge shape of the retaining element.

FIG. 15 shows an embodiment with which the wedges 608 are rounded off at each tip. By this means, too, the surface engaging with the locking surface 5 can be enlarged. Apart from that, with the embodiment according to FIG. 15, each of the retaining elements 606, in accordance with the embodiment according to FIG. 5, is thicker in the middle area **606*c* than in the edge area merging into the web 613. This ensures particularly good longitudinal stability of the retaining elements 606**.

Figure 16:
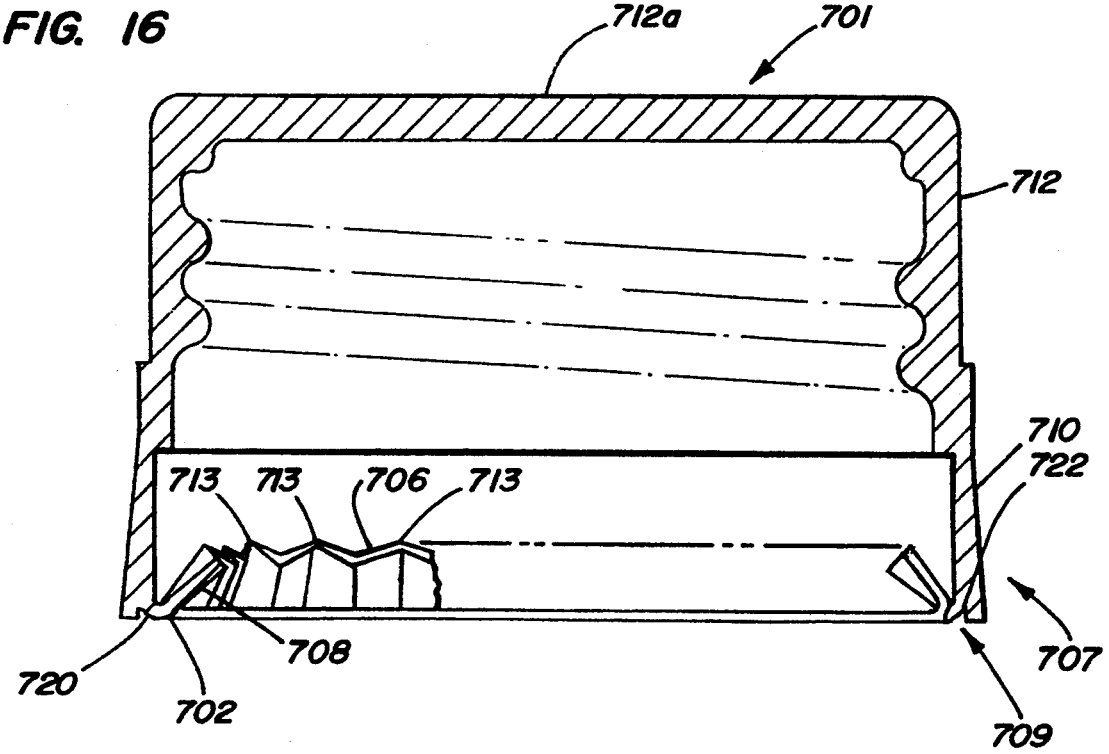
FIG. 16 is a sectional representation of a modified embodiment with a connecting portion in sectional representation taken along the line A—A in FIG. 17.
Figure 17:
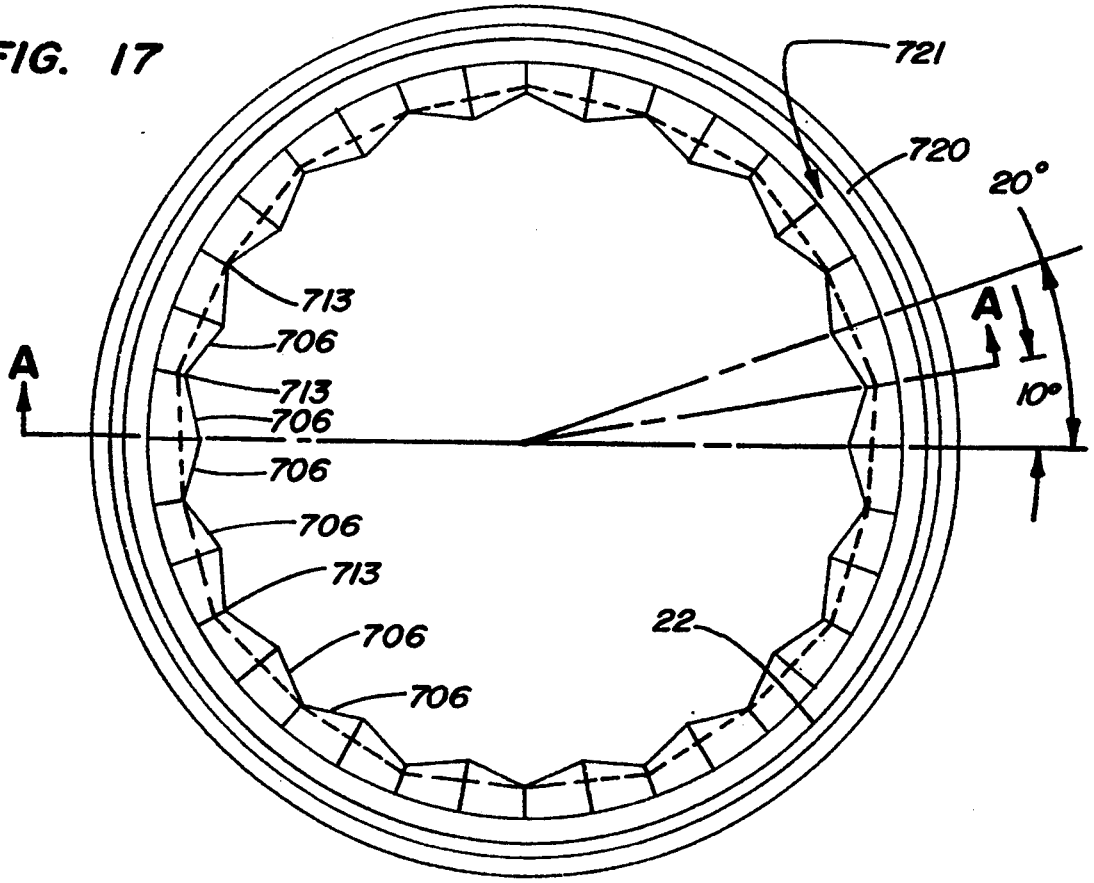
FIG. 17 is a view from below of the tamper-indicating closure according to FIG. 16.

FIG. 16 shows a modified embodiment of a tamper-indicating closure 701, which is manufactured by injection molding. No frangible line has yet been provided between the tamper-indicating band 707 and the cylindrical cap skirt 712. This can be subsequently applied, for example by cutting. A circumferential connecting portion 720 is provided as a hinge element 709 which runs off into an approximately radial bead 721 directed inwardly. The individual retaining elements 706 are connected on their underside with the bead 721 and the connecting portion 720. At the same time, a circumferential indentation 722 is provided on the underside of the upper tamper-indicating band portion 710, said indentation approximately dividing the wall thickness of the portion 710. The connecting portion 720 is provided on the inner side of the indentation 722 and, with that, possesses approximately half the thickness of the tamper-indicating band portion 710. The connecting portion 720 runs, with that, with an angle of approximately 45 degrees to the longitudinal axis of the tamper-indicating closure 701. Evidently the retaining elements 706 can be pivoted relatively elastically when placing of the tamper-indicating closure 701 on a container neck. With that, the entire connecting portion 720, with the bead 721, bends unimpededly inwards.

During opening, the forces exerted in the longitudinal direction of the retaining elements 706 are, in contrast, lead through an acute angle directly into the wall of the upper tamper-indicating portion 710, and will thus be transmitted to the frangible line 711 (FIGS. 1 to 15). The bead 721 strengthens, with that, the connecting portion 720 against deformation in the case of forces directed downwards. In addition, the bead 721 hinders manipulation on the retaining elements.

Inasmuch as the invention is subject to modifications and variations, the foregoing description and accompanying drawings should not be regarded as limiting the invention, which is defined by the following claims and various combinations thereof:

I claim:

1. A tamper-indicating closure for closure of a container of the type that possesses at least one locking surface (5) on a container neck (3), comprising:

a closure cap with a cap base (**12*a*) and a cylindrical cap skirt (12), and a tamper-indicating band (7) which is connected with the cap skirt (12) and is able to be separated at least partially from the cap skirt (12) along a frangible line (11), the tamper-indicating band (7) possessing an upper portion (10**) which extends downwardly from the cap skirt (12), and a plurality of retaining elements (6) on the tamper-indicating band (7), said retaining elements (6) each having a wedge shape extending substantially along its length, each retaining element (6) further being connected with an adjacent retaining element by a flexible web (13, 13*a*, 13*b*) that comprises a frangible line, wherein the retaining elements (6), after placement onto the container (2), are constructed to project radially inwards and upwards in the direction towards the cap base (12*a*) from the upper portion (10) of the tamper-indicating band (7), and are thereby brought into engagement with the locking surface (5) on the container neck (3).

2. A tamper-indicating closure according to claim 1, wherein the retaining elements (6) possess a V-shaped cross section in a plane parallel to the cap base (12*a*).

3. A tamper-indicating closure according to claims 1 or 2, wherein the frangible line (11) separating said tamper-indicating band (7) and said cap skirt (12) comprises a plurality of connecting bridges (16) which are arranged at a distance from one another.

4. A tamper-indicating closure according to claims 1 or 2, wherein the frangible line (11) separating said tamper-indicating band (7) and said cap skirt (12) comprises an area with a weakening of the material.

5. A tamper-indicating closure according to one of the preceding claims 1 or 2, wherein each of the retaining elements (6) is connected by a hinge element (9) with the cap skirt (12).

6. A tamper-indicating closure according to claim 5, wherein the hinge element (9) possesses a connecting portion (20) that is connected with a lower edge of the upper tamper-indicating band portion (10) and whose wall thickness is thinner than the wall thickness of the upper portion (10) of the tamper-indicating band (7) and which runs at a radially inwardly and downwardly directed angle $\alpha$.

7. A tamper-indicating closure according to claim 6, wherein the angle $\alpha$ amounts to between 30° and 60° in relation to the longitudinal axis of the tamper-indicating closure (1).

8. A tamper-indicating closure according to claim 7, wherein the angle $\alpha$ amounts to approximately 45°.

9. A tamper-indicating closure according to claim 7, wherein a lower edge of the upper portion (10) possesses an indentation (22) and the connecting portion (20) is arranged on side lying radially inwards from the indentation (22).

10. A tamper-indicating closure according to claim 6, wherein the hinge element (9) is collectively provided for a plurality of retaining elements (6) and the individual retaining elements (6) project radially inwards from the hinge element (9).

11. A tamper-indicating closure according to claim 10, wherein the hinge element (9) possesses an approximately radially inwardly directed, annular bead (21).

12. A tamper-indicating closure according to one of the preceding claims 1 or 2, wherein the retaining elements (6) are formed as two parts and are provided with a web (6*a*) in a vertex of the wedge shape (8).

13. A tamper-indicating closure according to one of the preceding claims 1 or 2, wherein a surface of the retaining elements (6) that is oriented towards the container neck (3) is provided with at least two wedge tips (8*a*, 8*b*).

* * * * *